US006742512B1

(12) United States Patent
Ho et al.

(10) Patent No.: US 6,742,512 B1
(45) Date of Patent: Jun. 1, 2004

(54) PAINTBALL GUNS HAVING HOPPER, ADAPTER AND/OR FEED TUBE AIMING/ POINTING DEVICE MOUNTING ASSEMBLIES

(75) Inventors: Stephen Ho, Sugarland, TX (US); Kheng Phang, Sugarland, TX (US)

(73) Assignee: Avalon Manufactoring Co., Houston, TX (US)

( * ) Notice: Subject to any disclaimer, the term of this patent is extended or adjusted under 35 U.S.C. 154(b) by 0 days.

(21) Appl. No.: 10/602,011

(22) Filed: Jun. 23, 2003

(51) Int. Cl.[7] ..... F41B 11/02
(52) U.S. Cl. ..... 124/49; 124/74
(58) Field of Search ..... 124/45, 48, 49, 124/51.1, 73, 74

(56) References Cited

U.S. PATENT DOCUMENTS

| | | | | |
|---|---|---|---|---|
| 4,890,597 A | | 1/1990 | Ekstrom | 124/74 |
| 5,282,454 A | | 2/1994 | Bell et al. | 124/49 |
| 5,494,024 A | | 2/1996 | Scott | 124/73 |
| 5,505,188 A | | 4/1996 | Williams | 124/74 |
| 5,515,838 A | | 5/1996 | Anderson | 124/76 |
| 5,572,982 A | | 11/1996 | Williams | 124/74 |
| 5,597,164 A | | 1/1997 | Dodds | 273/371 |
| 5,599,187 A | | 2/1997 | Mesiano | 434/19 |
| 5,630,406 A | | 5/1997 | Dumont | 124/56 |
| 5,669,369 A | | 9/1997 | Scott | 124/73 |
| 5,673,679 A | | 10/1997 | Walters | 124/53.5 |
| 5,778,868 A | | 7/1998 | Shepherd | 124/76 |
| 5,791,325 A | | 8/1998 | Anderson | 124/56 |
| 5,809,983 A | | 9/1998 | Stoneking | 124/50 |
| 5,816,232 A | * | 10/1998 | Bell | 124/51.1 |
| 5,850,826 A | | 12/1998 | Guthrie | 124/62 |
| 5,896,850 A | | 4/1999 | Sullivan, Jr. | 124/74 |
| 5,927,261 A | | 7/1999 | Bofill | 124/80 |
| 5,931,342 A | | 8/1999 | Taylor | 222/5 |
| 5,947,100 A | | 9/1999 | Anderson | 124/45 |
| 5,950,611 A | | 9/1999 | Lopez et al. | 124/72 |
| 5,988,153 A | | 11/1999 | Yoshimura | 124/81 |
| 5,993,215 A | | 11/1999 | Kotsiopoulos et al. | 434/21 |
| 6,003,504 A | | 12/1999 | Rice et al. | 124/73 |
| 6,003,547 A | | 12/1999 | Tippmann, Jr. | 137/588 |
| 6,062,208 A | | 5/2000 | Seefeldt et al. | 124/71 |
| 6,109,252 A | | 8/2000 | Stevens | 124/51.1 |
| 6,138,656 A | | 10/2000 | Rice et al. | 124/73 |
| 6,142,137 A | | 11/2000 | MacLaughlin | 124/72 |
| 6,193,410 B1 | | 2/2001 | Puckett, II | 366/348 |
| 6,199,286 B1 | | 3/2001 | Reed, Jr. et al. | 33/265 |
| 6,213,112 B1 | | 4/2001 | Squire | 124/74 |
| 6,223,658 B1 | | 5/2001 | Rosa et al. | 102/501 |
| 6,226,915 B1 | | 5/2001 | Kotsiopoulos | 42/71.02 |
| 6,233,928 B1 | | 5/2001 | Scott | 60/407 |
| 6,273,079 B1 | * | 8/2001 | Jzn | 124/49 |
| 6,273,080 B1 | | 8/2001 | Sullivan, Jr. | 124/84 |
| 6,276,354 B1 | | 8/2001 | Dillon | 124/74 |
| 6,280,080 B1 | | 8/2001 | Puckett, II | 366/348 |
| 6,305,367 B1 | | 10/2001 | Kotsiopoulos et al. | 124/49 |
| 6,305,941 B1 | | 10/2001 | Kotsiopoulos et al. | 434/11 |
| 6,367,465 B1 | | 4/2002 | Buccieri, Jr. | 124/31 |
| 6,371,099 B1 | | 4/2002 | Lee | 124/66 |
| 6,378,367 B1 | | 4/2002 | Dilz, Jr. | 73/448 |
| 6,408,837 B1 | * | 6/2002 | Johnson et al. | 124/51.1 |
| 6,481,432 B2 | * | 11/2002 | Rushton et al. | 124/49 |
| 6,502,567 B1 | * | 1/2003 | Christopher et al. | 124/51.1 |
| 6,532,949 B1 | | 3/2003 | McKendrick | 124/77 |
| 6,546,950 B1 | | 4/2003 | Juan | 137/270 |

FOREIGN PATENT DOCUMENTS

| | | | |
|---|---|---|---|
| DE | 0 909 936 A2 | 10/1998 | F41B/11/06 |

* cited by examiner

*Primary Examiner*—John A. Ricci
(74) *Attorney, Agent, or Firm*—Robert W. Strozier

(57) ABSTRACT

A paintball gun is disclosed, which includes at least one aiming and/or pointing device mount assembly connected to, affixed to or integral with a paintball gun's hopper, adapter, and/or feed tube.

19 Claims, 7 Drawing Sheets

PAINTBALL GUNS HAVING HOPPER, ADAPTER AND/OR FEED TUBE AIMING/ POINTING DEVICE MOUNTING ASSEMBLIES

BACKGROUND OF THE INVENTION

1. Field of the Invention

The present invention relates to a paintball gun including an aiming mounting assembly for mounting an aiming apparatus and a timing apparatus.

More particularly, the present invention relates to a paintball gun including an aiming mounting assembly that attaches to or is integral with a hopper/magazine, an adapter, and/or a feed tube, where the assembly permits rotation about two axes so that the aiming device can be properly aligned and a timing apparatus mounted on the hopper/magazine.

2. Description of the Related Art

Numerous types of paintball guns have been developed and used in a variety of manners, such as in simulated war games. These paintball guns are generally powered by $CO_2$ cartridges or cylinders which, generally, propel the paintballs at a specified velocity, such as three hundred (300) feet per second out of the gun barrel. In general, the prior art paintball guns include a typical firearm type mechanism including a bolt, spring and cocking handle.

Some of these prior art paintball guns include aiming devices such as laser pointing devices, scopes, flash lights, or the like. But due to the hopper, much of the paintball gun is not readily amenable to attachment of an aiming device.

Thus, there is a need in the art for improved paintball guns with mounting assemblies for aiming devices, where the mounting assembly are not obstructed by components of the gun, and especially where the mounting assemblies are attached to or integral with either the hopper, the adapter, and/or the feed tube of a paintball gun.

SUMMARY OF THE INVENTION

The present invention provides a paintball gun including at least one aiming device mounting assembly associated with the hopper, the feed tube, and/or the adapter and a timing apparatus attached to or integral with the hopper.

The present invention also provides a paintball gun apparatus including: a gun assembly having a handle, a barrel, and a paintball feed tube; a feeder/hopper or magazine; optionally an adapter, and at least one aiming and/or pointing device mounting assembly and a timing apparatus attached to or integral with the hopper. The mounting assemblies preferably have two axes of adjustment so that the aiming and/or pointing device can be adjusted up and down and side to side. The aiming and/or pointing assemblies can be attached to or integral with the hopper, the feed tube, and/or the optional adapter.

The present invention also provides a paintball gun apparatus including: a gun assembly having a handle, a barrel, and a paintball feed tube; a feeder/hopper or magazine; optionally an adapter; at least one aiming and/or pointing device mounting assembly; and at least one aiming and or pointing device detachably connected to the at least one mounting assembly. The mounting assemblies preferably have two axes of adjustment so that the aiming and/or pointing device can be adjusted up and down and side to side. The aiming and/or pointing assemblies can be attached to or integral with the hopper, the feed tube, and/or the optional adapter.

The present invention also provides a method for improving aiming and/or pointing of a paintball gun, including the steps of: attaching an aiming and/or pointing device to an aiming and/or pointing device mounting assembly attached to or integral with a hopper, an adapter and/or a feed tube and aiming the paintball gun and firing with the aid of either an aiming device such as a scope or a pointing device such as a laser pointer or both.

DESCRIPTION OF THE DRAWINGS

The invention can be better understood with reference to the following detailed description together with the appended illustrative drawings in which like elements are numbered the same.

DETAILED DESCRIPTION OF THE INVENTION

Figure 1A:
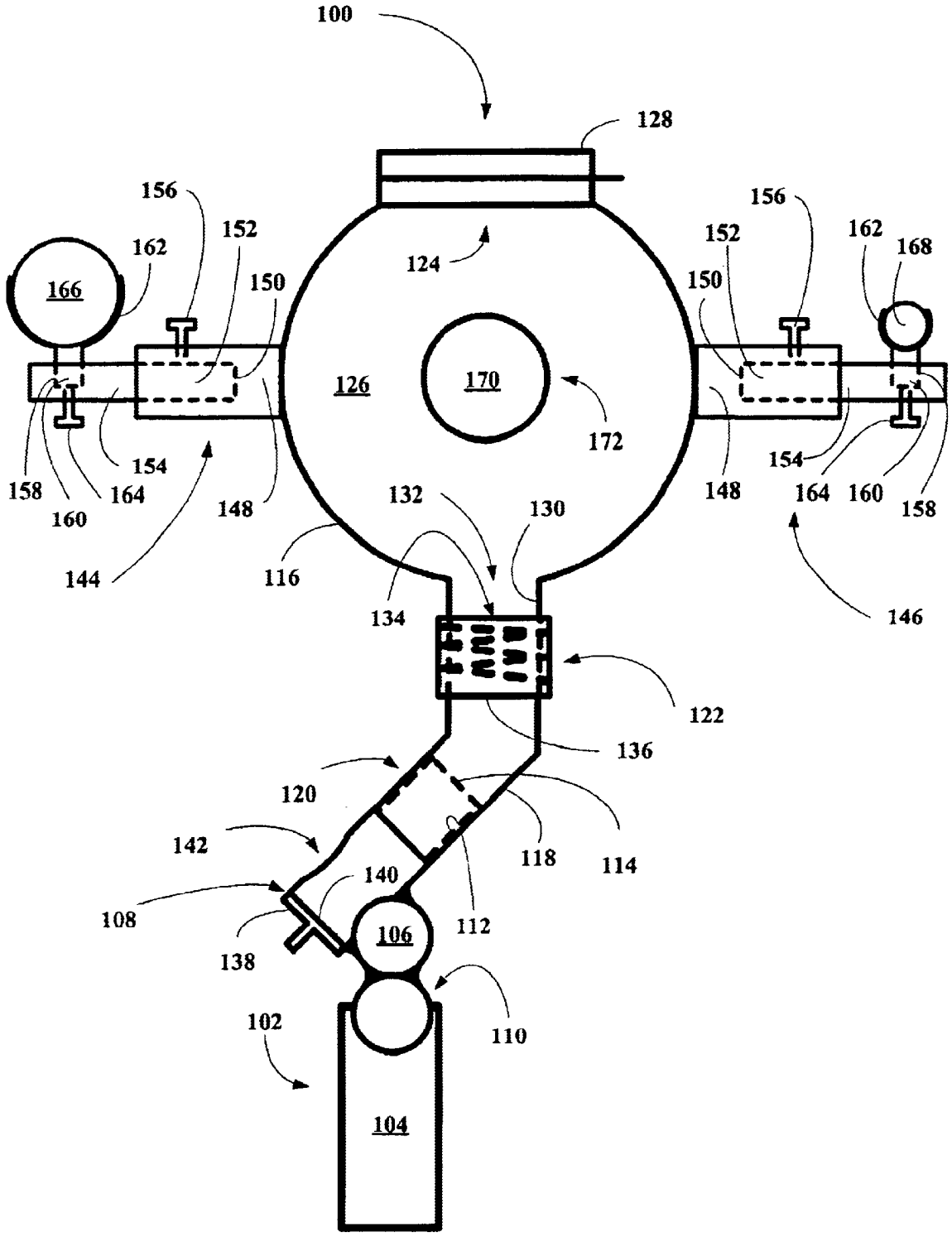
FIGS. 1A&B depict a preferred embodiment of a paintball gun including a hopper having a scope mounting assembly on a barrel side of the hopper, an aiming apparatus mounting assembly on a side opposite the barrel side, the non-barrel side, and a timing apparatus mounting assembly on a back side of the hopper, where the hopper is mounted on an angled adapter, FIG. 1A, or a straight adapter, FIG. 1B.

The inventors have found that a paintball gun can be constructed to include at least one aiming device mounting assembly associated with (connected to or integral with) the hopper, the feed tube, and/or the adapter and a timing apparatus attached to or integral with the hopper. The mounting assemblies on the hopper, the feed tube, and/or the adapter are designed to accommodate a scope like aiming device or a pointing like aiming device or a combination of both a scope type and a pointing type aiming device. The timing apparatus is designed to provide the user with time information clearly visible to the user when properly aiming, holding and firing the paintball gun.

The present invention broadly relates to a paintball gun including at least one aiming and/or pointing device mounting assembly associated with (connected to or integral with) the hopper, the feed tube, and/or the adapter and a timing apparatus attached to or integral with the hopper. The present invention also relates to a paintball gun including a scope type device and/or a pointing type device mounted on the mounting assembly.

The present invention also broadly relates to a method for aiming a paintball gun including the steps of: mounting at least one aiming and/or pointing device on at least one mounting assembly associated with (connected to or integral with) the hopper, the feed tube, and/or the adapter.

The hopper can be constructed in any suitable material geometry, provided that the paintballs can reliably flow from the hopper/feeder apparatus through a delivery conduit to the barrel of the paintball gun for ultimate firing from the gun. Preferred geometric shapes include, without limitation, banana-shapes, spherical shapes, hemispherical shapes, quadrilateral shapes such as square or rectangular shapes, triangular shapes, or any other shape that provides a paintball reservoir and a conduit for paintballs to drop from the reservoir to the gun barrel one at a time. The hopper/feeder apparatus or magazine can be of a unitary construction or can be constructed of multiple parts that are fastened together by fasteners or snap together as is well known in the art.

The adapter can be constructed in either an angled shape or a straight shape depending on the type of paintball gun. The adapter and the hopper can have threaded connections as set forth in co-pending application U.S. application Ser. No. 10/117,673, incorporated herein by reference.

Suitable materials out of which,the hopper/feeder apparatus, the adapters, and the mounting assembly can be constructed include, without limitations, metals, plastics, composites, ceramics, or the like, or mixtures or combinations thereof. Preferably, the apparatuses are constructed out of plastics or composites or mixtures or combinations thereof. Suitable metals include, without limitation, aluminum and its alloys such as aluminum-magnesium alloys or the like, titanium, steel or other iron alloys, copper and its alloys such as bronze, brass or the like, or any other metal or its alloys and mixture or combinations thereof. Suitable plastics include, without limitation, polyolefins such as polyethylene, polypropylene, polyoutylene, polyhexylene, polystyrene, polyalphamethylstyrene, or the like or copolymers thereof, acrylics, urethanes, polyesters, thermoplastics, thermal setting resins, thermoplastic elastomers, liquid crystal polymers, polyalkyleneoxides, or any other structural plastic suitable for making a durable paintball hopper/feeder apparatus. Suitable composites includes, without limitation, polymer matrices selected from the plastics listed above reinforced by a fiber such as carbon fibers, polyamides such as Kevlar, boron-nitride fibers, glass fibers, or the like or mixture or combination thereof.

The hopper can also include a covering. Suitable material out of which the hopper/feeder apparatus covers can be made include, without limitation, elastomers such as natural or synthetic rubbers or the like, urethanes rubbers, silicon rubbers or any other resilient and shock absorbing materials or mixtures or combinations thereof.

The hopper can also include a locking device as set forth in co-pending U.S. patent application Ser. Nos. 10/187,386 and 10/430,681, incorporated herein by reference.

The mounting assemblies can be attached to or affixed to the feed tube, the hopper and/or the adapter by any method, apparatus or technique currently known in the art or that is yet to be invented. Such techniques include cementing or gluing, melt flowing the materials together, groove and tab connectors, threaded connectors, velcro connectors, or any other similar type mechanical or chemical connectors or connecting processes.

Suitable aiming and pointing devices include, without limitation, scopes such as normal scopes and night vision scopes, laser pointers, flash lights, other device capable of producing a columnated beam of light, an acoustic distance gauge or sensor, an IR distance gauge or sensor, IR or sonic motion sensors, or any other viewing device, pointing device or motion sensing device.

Figure 1B:
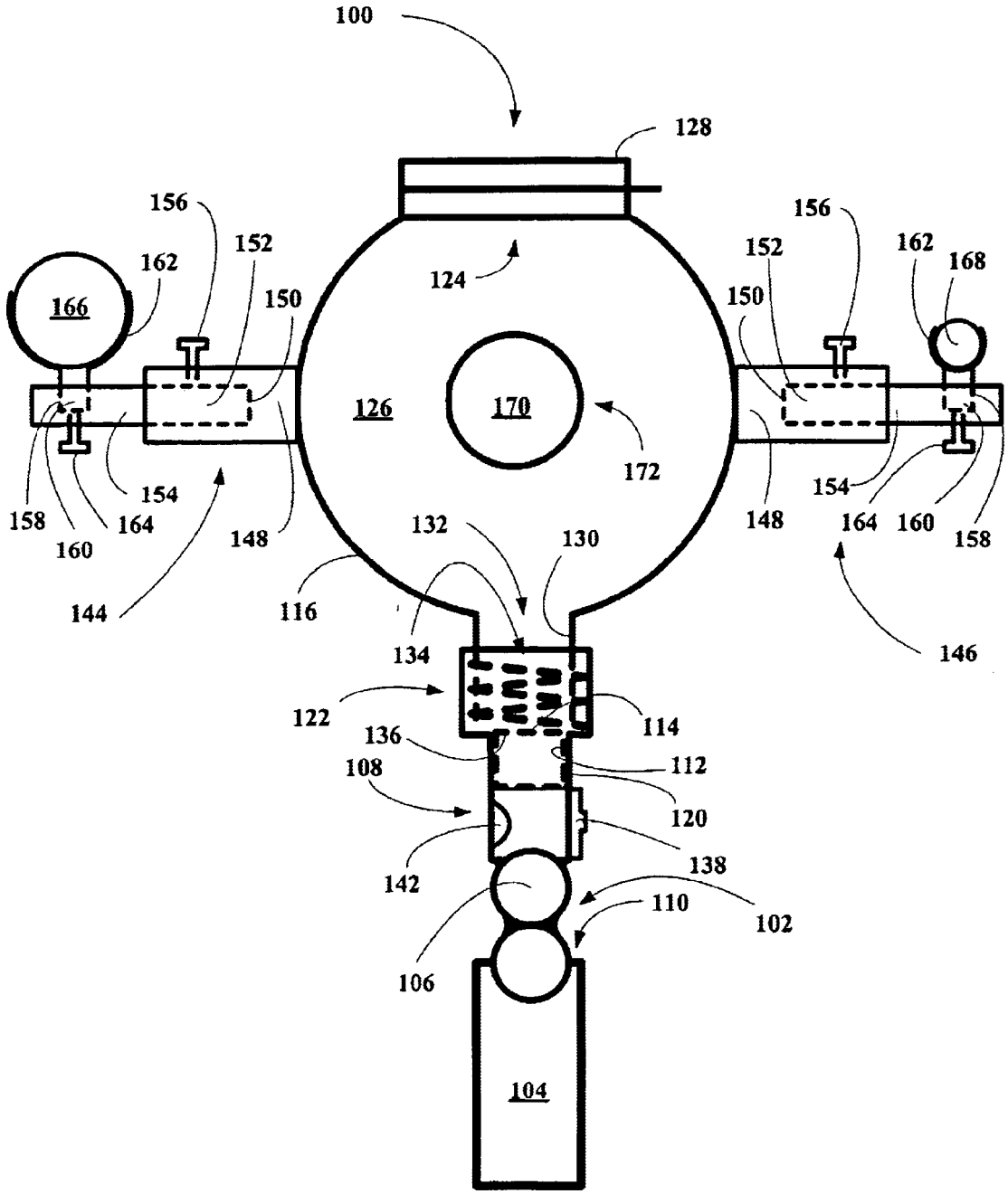

Referring now to FIGS. 1A&B, a preferred embodiment of a paintball gun of this invention, generally 100, is shown to include a gun body 102 having a handle 104, a barrel 106 and a hollow, paintball feeding tube 108 extending upward from the barrel 106 near its handle end 110. The feeding tube 108 includes a male connector 112 at its distal end 114, which can be threaded or unthreaded. The gun 100 also includes a paintball dispenser or hopper 116 and a bent connecting member or adapter 118 as shown in FIG. 1A and a straight connecting member or adapter 118 as shown in FIG. 1B. The adapter 118 includes a female connector 120 for engaging the feed tube connector 112, which can be threaded or unthreaded, and a female, threaded hopper connector 122. The hopper 116 includes an opened first end 124, a paintball reservoir 126, and a lid 128. The lid 128 is designed to engage the opened end 124 so that the opened end 124 can be closed after the hopper 116 is filled with paintballs (not shown). The hopper 116 further includes a paintball dispensing neck 130 depending from a lower central region 132, where the neck 130 includes a male, threaded connector 134 at this distal end 136, where the connectors 122 and 134 are designed to lockingly secure the paint dispenser 116 to the adapter 118 and the connectors 112 and 120 are designed to secure the adapter 118 to the feed tube 108. The feed tube 108 also includes a safety 138 at its proximal end 140 and a view slot 142. The gun 100 also includes a barrel side two axis rotatable mounting assembly 144 and a non-barrel side two axis rotatable mounting assembly 146, attached to or affixed to or integral, with the hopper 116. The assemblies 144 and 146 include a hopper extension member 148 having an aperture 150 designed to receive a post 152 of an aiming device receiving member 154 so that the member 154 can be rotated about the post 152 providing a first degree of rotational freedom. The extension member 148 also includes a locking member 156 adapted to hold the post 152 in place so that a particular orientation can be fixed. The receiving member 154 includes an aperture 158 designed to receive a second post 160 of a receiver 162 so that the receiver 162 can be rotated about the post 162 providing a second degree of freedom. The receiving member 154 also includes a locking member 164 adapted to hold the second post 160 in place so that the particular orientation can be fixed. The assembly 144 is shown holding a scope 166; while the assembly 146 is shown holding a laser pointer 168. The hopper 118 also includes a time keeping apparatus 170 affixed thereto or attached thereto or integral therewith in a center rear region 172 thereof.

Figure 2A:
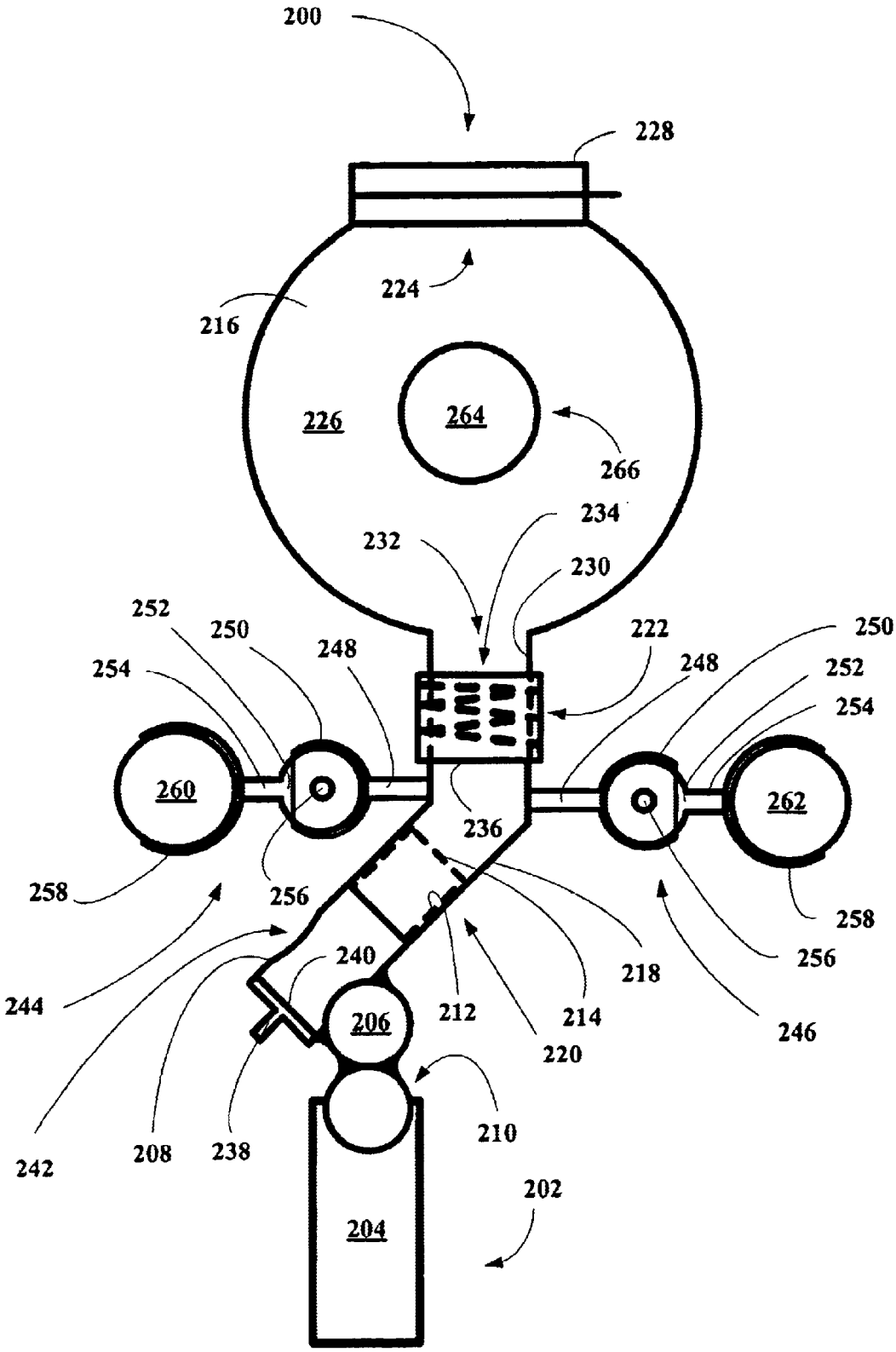
FIGS. 2A–B depict another preferred embodiment of a paintball gun including a hopper, an adapter having a scope mounting assembly on a barrel side of the hopper, an aiming apparatus mounting assembly on a side opposite the barrel side, the non-barrel side, and a timing apparatus mounting assembly on a back side of the hopper, where the adapter is angled, FIG. 2A, or a straight, FIG. 2B.
Figure 2B:
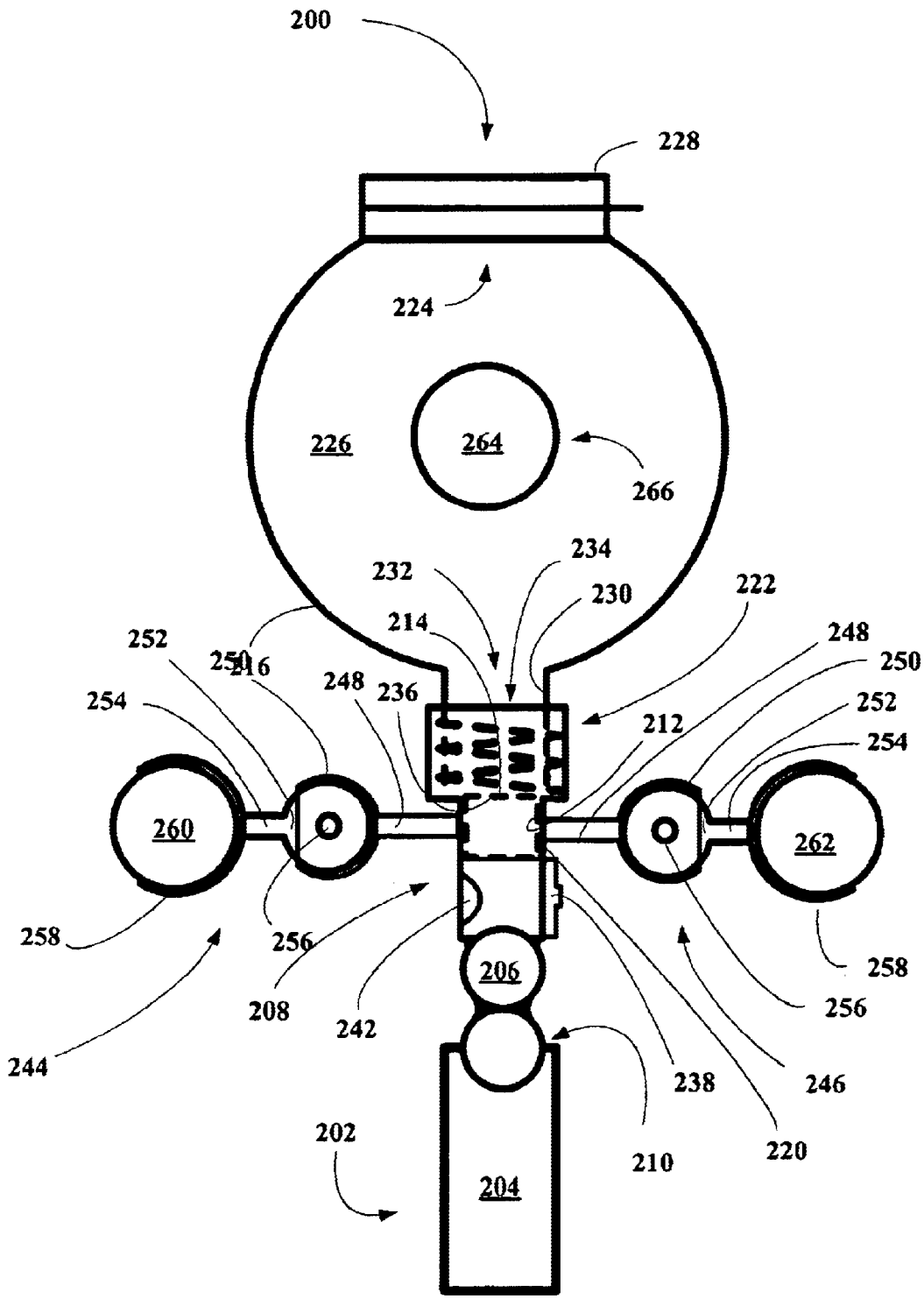

Referring now to FIGS. 2A&B, another preferred embodiment of a paintball gun of this invention, generally 200, is shown to include a gun body 202 having a handle 204, a barrel 206 and a hollow, paintball feeding tube 208 extending upward from the barrel 206 near its handle end 210. The feeding tube 208 includes a male connector 212 at its distal end 214. The gun 200 also includes a paintball dispenser or hopper 216 and a bent connecting member or adapter 218 as shown in FIG. 2A and a straight connecting member or adapter 218 as shown in FIG. 2B. The adapter 218 includes a female connector 220 for engaging the feed tube connector 212, which can be threaded or unthreaded, and a female, threaded hopper connector 222. The hopper 216 includes an opened first end 224, a paintball reservoir 226, and a lid 228. The lid 228 is designed to engage the opened end 224 so that the opened end 224 can be closed after the hopper 216 is filled with paintballs (not shown). The hopper 216 further includes a paintball dispensing neck 230 depending from a lower central region 232, where the neck 230 includes a male, threaded connector 234 at this distal end 236, where the connectors 222 and 234 are designed to lockingly secure the paint hopper 216 to the adapter 218 and the connectors 212 and 220 are designed to secure the adapter 218 to the feed tube 208. The feed tube 208 also includes a safety 238 at its proximal end 240 and a view slot 242. The gun 200 also includes a barrel side two axis rotatable mounting assembly 244 and a non-barrel side two axis rotatable mounting assembly 246, attached to or affixed to or integral with the adapter 218. The assemblies 244 and 246 include an adapter extension member 248 having a spherical socket 250 designed to receive a ball 252 of an aiming device receiving member 254 so that the member 254 can be rotated about two independent degrees of freedom. The socket 250 includes a locking member 256 adapted to hold the ball 252 in place so that a particular orientation can be fixed. The receiving member 254 includes a receiver 258 adapted to receive and hold an aiming device and/or a pointing device. The assembly 244 is shown holding a scope 260; while the assembly 246 is shown holding a laser pointer 262. The hopper 218 also includes a time keeping apparatus 264 affixed or attached thereto in a center rear region 266 thereof.

Figure 3A:
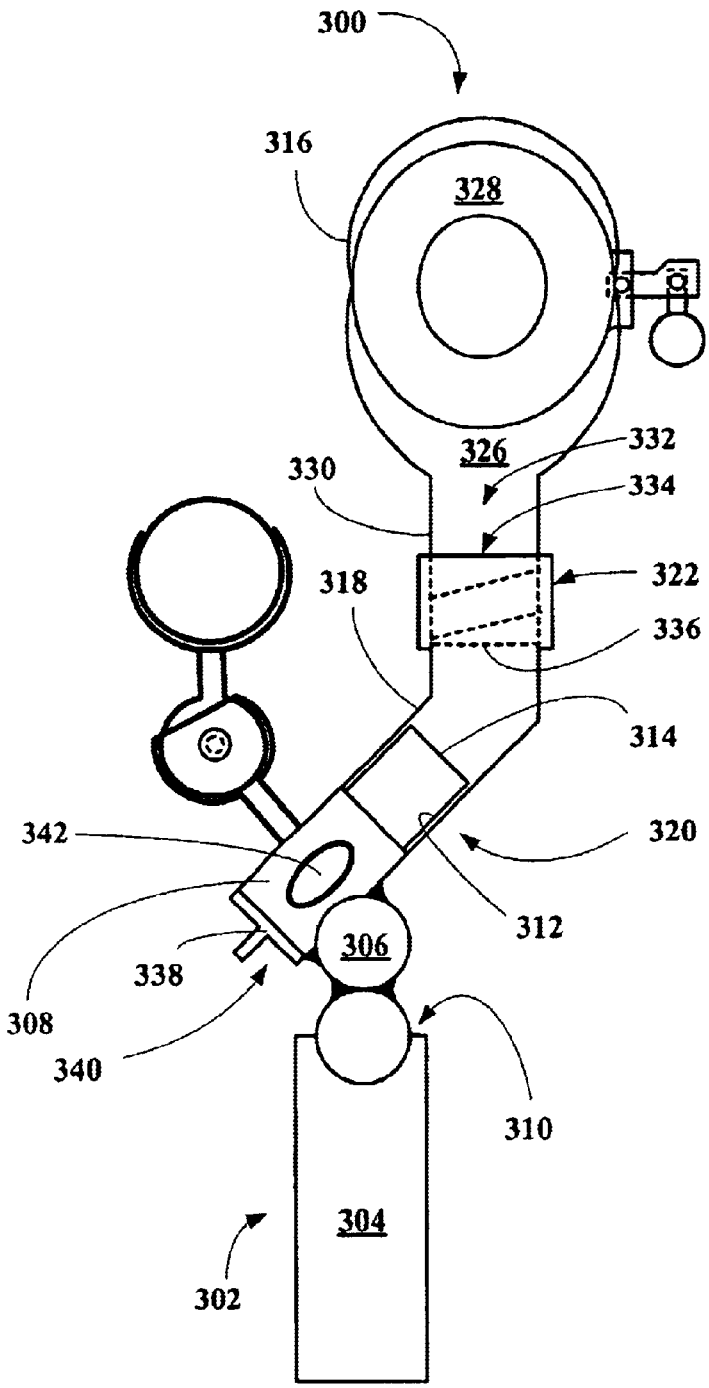
FIGS. 3A–B depict a front view and a hopper rotated side view another preferred embodiment of a paintball gun including a feed tube having a scope mounting assembly on a barrel side thereof, a hopper having an aiming apparatus mounting assembly on a side opposite the barrel side, the non-barrel side, an adapter and a timing apparatus mounting assembly on a back side of the hopper.
Figure 3B:
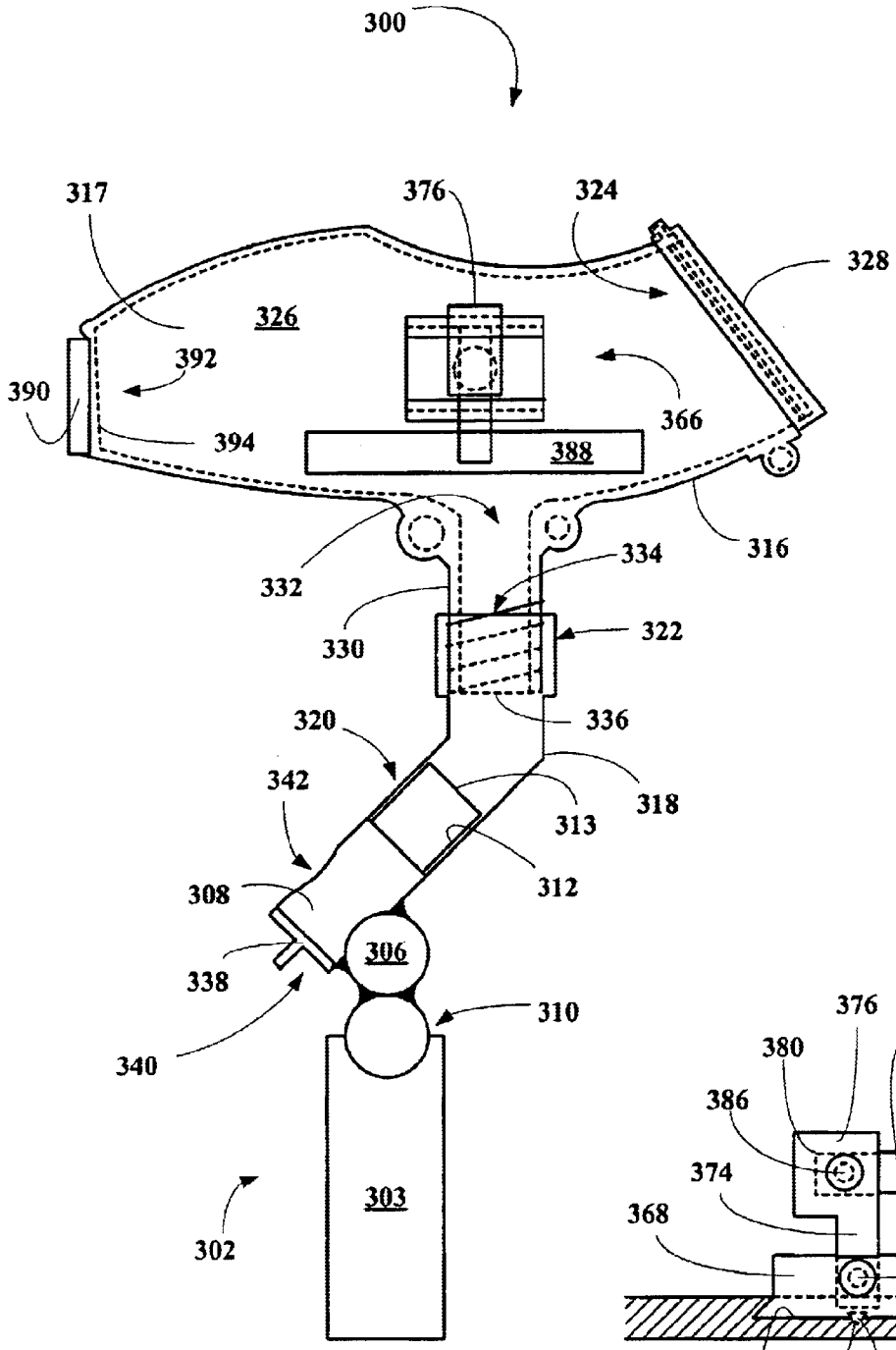
Figure 3C:
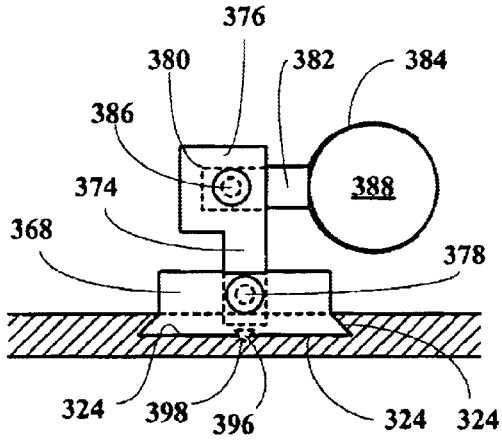
FIG. 3C depict an expanded view of the hopper mounting assembly of FIG. 3A&B.

Referring now to FIGS. 3A&B, a front and side view of a preferred embodiment of a paintball gun of this invention, generally 300, is shown to include a gun body 302 having a handle 304, a barrel 306 and a hollow, paintball feeding tube 308 extending upward from the barrel 304 near its handle end 310. The feeding tube 308 includes a male connector 312, which can be threaded or unthreaded, at its distal end 314. The gun 300 also includes a paintball dispenser or hopper 316 and a bent connecting member or adapter 318. The adapter 318 includes a female connector 320, which can be threaded or unthreaded, for engaging the feed tube connector 312 and a female, threaded hopper connector 322. The hopper 316 includes an opened first end 324, a paintball reservoir 326, and a lid 328. The lid 328 is designed to engage the opened end 324 so that the opened end 324 can be closed after the hopper 316 is filled with paintballs (not shown). The hopper 316 further includes a paintball dispensing neck 330 depending from a lower central region 332, where the neck 330 includes a male, threaded connector 334 at this distal end 336, where the connectors 322 and 334 are designed to lockingly secure the paint dispenser 316 to the adapter 318 and the connectors 312 and 320 are designed to secure the adapter 318 to the feed tube 308. The feed tube 308 also includes a safety 338 at its proximal end 340 and a view slot 342. The gun 300 also includes a barrel side two axis rotatable mounting assembly 344 (shown in FIG. 3A, but not in FIG. 3B) and a non-barrel side two axis rotatable mounting assembly 346. The assembly 344 is attached to or affixed to or integral with the feed tube 308, while the assembly 346 is attached to non-barrel side 317 of the hopper 316. The assembly 344 includes a feed tube extension member 348 having a spherical socket 350 designed to receive a ball 352 of an aiming device receiving member 354 so that the member 354 can be rotated about two independent degrees of freedom. The socket 350 includes a locking member 356 adapted to hold the ball 352 in place so that a particular orientation can be fixed. The receiving member 354 includes a receiver 358 adapted to receive and hold an aiming device and/or a pointing device. The assembly 344 is shown holding a scope 360. Looking at FIG. 3B&C, the assembly 346 includes a groove 362 in the hopper 316 for receiving a tab 364 of a detachable mounting sub-assembly 366. The sub-assembly 366 also includes an extension member 368, the distal end 370 of which is the tab 364, having an aperture 372 for receiving a first post 374 of an aiming device receiving member 376 so that the member 376 can be rotated about the post 374 providing a first degree of rotational freedom. The extension member 368 also includes a locking member 378 adapted to hold the post 374 in place so that a particular orientation can be fixed. The receiving member 376 includes an aperture 380 designed to receive a second post 382 of a receiver 384 so that the receiver 384 can be rotated about the post 382 providing a second degree of freedom. The receiving member 376 also includes a locking member 386 adapted to hold the second post 382 in place so that the particular orientation can be fixed. The sub-assembly 364 is shown holding a laser pointer 388. The hopper 316 also includes a time keeping apparatus 390 affixed thereto or attached thereto or integral therewith in a center rear region 392 thereof. The hopper 316 has a modified banana shape with a straight rear section 394 where the time keeping apparatus 390 is located. The member 368 also includes a baised locking tab 396 and an associated locking groove 398 in the hopper 316.

Figure 4:
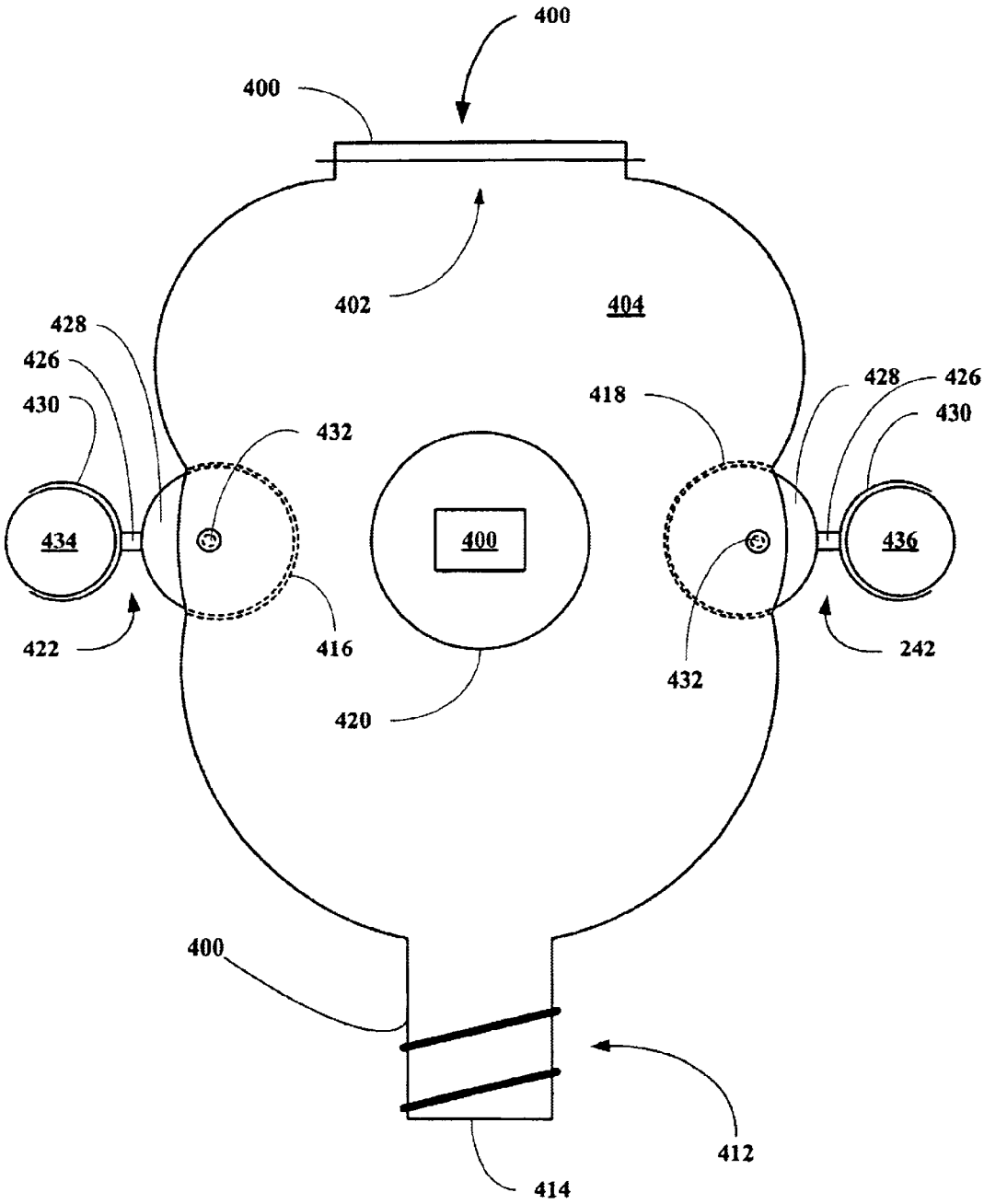
FIG. 4 depicts a hopper preferred embodiment of a hopper having a scope mounting assembly on a barrel side of the hopper, an aiming apparatus mounting assembly on a side opposite the barrel side, the non-barrel side, and a timing apparatus mounting assembly on a back side of the hopper.

Referring now to FIG. 4, a preferred embodiment of a paintball gun hopper of this invention, generally 400, is shown to include an opened first end 402, a paintball reservoir 404, and a lid 406. The lid 406 is designed to engage the opened end 402 so that the opened end 402 can be closed after the hopper 400 is filled with paintballs (not shown). The hopper 400 further includes a paintball dispensing neck 408 depending from a lower central region 410, where the neck 408 includes a male, threaded connector 412 at this distal end 414, where the connector 412 is designed to lockingly secure the hopper 400 to an adapter (not shown) or a feed tube (not shown). The hopper 400 also includes a left side socket 416, a right side socket 418 and a time keeping apparatus 420. The left and right side sockets 416 and 418 are designed to receive two axis rotatable mounting assemblies 422 and 424. The assemblies 422 and 424 include an extension member 426 having a ball 428 of a receiver 430, where the ball 428 and the socket 416 or 418 allow the member 426 to rotated about two independent degrees of freedom. The sockets 416 and 418 includes a locking member 432 adapted to hold the balls 428 in place so that a particular orientation can be fixed. The assembly 422 is shown holding a scope 434; while the assembly 424 is shown holding a laser pointer 436. The time keeping apparatus 420 is shown with a display 438 and can also include other audio and/or visual components as well as GPS components and wireless communication components.

All references cited herein are incorporated by reference. While this invention has been described fully and completely, it should be understood that, within the scope of the appended claims, the invention may be practiced otherwise than as specifically described. Although the invention has been disclosed with reference to its preferred embodiments, from reading this description those of skill in the art may appreciate changes and modification that may be made which do not depart from the scope and spirit of the invention as described above and claimed hereafter.

We claim:

1. A paintball gun comprising a handle, a barrel, a feed tube, a paintball hopper or magazine and at least one aiming and/or pointing device mounting assembly connected to or integral with the feed tube and/or the hopper.

2. The gun of claim 1, further comprising at least one aiming and/or pointing device mounted on the at least one mounting assembly.

3. The gun of claim 1, further comprising an aiming device mounting assembly connected to or integral with a barrel side of the feed tube or the hopper and a pointing device mounting assembly connected to or integral with a non-barrel side of the feed tube or the hopper.

4. The gun of claim 3, wherein the aiming device is a scope and the pointing device is a laser pointer.

5. The gun of claim 1, wherein the mounting assemblies comprise a receiver and two perpendicularly oriented swivels with locking devices so that the receiver can be rotated up and down and from side to side and locked into place with the locking devices.

6. The gun of claim 1, wherein the mounting assemblies comprise a socket, a ball having a receiver protruding therefrom, and a locking device, where the socket is designed to receive a ball and the locking device is designed to lock the ball at a desired orientation.

7. A paintball gun comprising a handle, a barrel, a feed tube, a paintball hopper or magazine, an adapter and at least one aiming and/or pointing device mounting assembly connected to or integral with the feed tube and/or the hopper.

8. The gun of claim 7, further comprising at least one aiming and/or pointing device mounted on the at least one mounting assembly.

9. The gun of claim 7, further comprising an aiming device mounting assembly connected to or integral with a barrel side of the feed tube, the hopper or the adapter and a pointing device mounting assembly connected to or integral with a non-barrel side of the feed tube, adapter or the hopper.

10. The gun of claim 9, wherein the aiming device is a scope and the pointing device is a laser pointer.

11. The gun of claim 7, wherein the mounting assemblies comprise a receiver and two perpendicularly oriented swivels with locking devices so that the receiver can be rotated up and down and from side to side and locked into place with the locking devices.

12. The gun of claim 7, wherein the mounting assemblies comprise a socket, a ball having a receiver protruding therefrom, and a locking device, where the socket is designed to receive a ball and the locking device is designed to lock the ball at a desired orientation.

13. A method for aiming a paintball gun comprising the steps of:

mounting at least one aiming and/or pointing device on a paintball gun comprising a handle, a barrel, a feed tube, a paintball hopper or magazine, an adapter and at least one aiming and/or pointing device mounting assembly connected to or integral with the feed tube and/or the hopper; and aiming the gun with the aiming and/or pointing device.

14. The method of claim 13, further comprising at least one aiming and/or pointing device mounted on the at least one mounting assembly.

15. The method of claim 13, further comprising an aiming device mounting assembly connected to or integral with a barrel side of the feed tube, the hopper or the adapter and a pointing device mounting assembly connected to or integral with a non-barrel side of the feed tube, adapter or the hopper.

16. The method of claim 15, wherein the aiming device is a scope and the pointing device is a laser pointer.

17. The method of claim 13, wherein the mounting assemblies comprise a receiver and two perpendicularly oriented swivels with locking devices so that the receiver can be rotated up and down and from side to side and locked into place with the locking devices.

18. The method of claim 13, wherein the mounting assemblies comprise a socket, a ball having a receiver protruding therefrom, and a locking device, where the socket is designed to receive a ball and the locking device is designed to lock the ball at a desired orientation.

19. The method of claim 13, further comprising the step of:

firing paintballs from the paintball gun at a target added by the aiming and/or pointing device.

* * * * *